US006813223B1

(12) United States Patent
Born et al.

(10) Patent No.: US 6,813,223 B1
(45) Date of Patent: Nov. 2, 2004

(54) PORTABLE OBJECT SUCH AS, IN PARTICULAR, A TIMEPIECE, INCLUDING A PIEZOELECTRIC TRANSDUCER FOR ENTERING DATA MANUALLY

(75) Inventors: Jean-Jacques Born, Morges (CH); Jean-Pierre Wattenhofer, Neuchâtel (CH)

(73) Assignee: Asulab S.A., Bienne (CH)

( * ) Notice: Subject to any disclaimer, the term of this patent is extended or adjusted under 35 U.S.C. 154(b) by 360 days.

(21) Appl. No.: 09/784,089

(22) Filed: Feb. 16, 2001

(30) Foreign Application Priority Data

Feb. 24, 2000 (CH) ..... 0360/00

(51) Int. Cl.[7] ..... G04C 21/12; G04B 39/00

(52) U.S. Cl. ..... 368/255; 368/296

(58) Field of Search ..... 368/72, 73, 88, 368/206, 228, 230, 243–244, 250, 255, 296, 242, 276, 315; 310/318

(56) References Cited

U.S. PATENT DOCUMENTS

| | | | | |
|---|---|---|---|---|
| 3,989,963 A | * | 11/1976 | Giaccardi | 310/318 |
| 4,232,241 A | * | 11/1980 | Hamatani | 310/317 |
| 4,242,745 A | * | 12/1980 | Mutrux | 368/73 |
| 4,618,264 A | | 10/1986 | Kamens et al. | |
| 4,761,582 A | * | 8/1988 | McKee | 310/322 |
| 4,769,797 A | | 9/1988 | Murakami | |
| 5,742,564 A | | 4/1998 | Kuschel et al. | |
| 6,577,559 B1 | * | 6/2003 | Fleury et al. | 368/250 |

FOREIGN PATENT DOCUMENTS

| | | | | |
|---|---|---|---|---|
| CH | 641 625 A3 | | 3/1984 | |
| GB | 1 582 507 A | | 1/1981 | |
| JP | 363212298 A | * | 9/1988 | 381/190 |
| JP | 401270694 A | * | 10/1989 | 368/206 |

OTHER PUBLICATIONS

Electrochimica Acta, GB, Elsevier Science Publishers, Barking, vol. 34, No. 3, Mar. 1, 1989, pp. 107–111, XP000025489, "Development of Electronic Watch With a Built–In Shock Sensor", K. Nishimura et al.

* cited by examiner

*Primary Examiner*—Tulsidas Patel
*Assistant Examiner*—Jeanne-Marguerite Goodwin
(74) *Attorney, Agent, or Firm*—Griffin & Szipl, P.C.

(57) ABSTRACT

The present invention concerns a portable object such as, in particular, a timepiece (1), including means (16) for displaying at least one data item and a case (2) formed of a top portion including a crystal (14) covering the display means (16) and a bottom portion delimited by a back cover (6) located below said display means (16), this object including a piezoelectric transducer (32) generating an electric voltage when mechanical pressure is exerted on said top portion, the voltage generated by the piezoelectric transducer (32) being applied to a first electronic circuit which will generate a logic signal in response to the pressure exerted, this electronic circuit being arranged inside said case (2), characterized in that said piezoelectric transducer (32) is arranged in the bottom portion of said case (2) and is rigidly connected to said case (2).

13 Claims, 3 Drawing Sheets

PORTABLE OBJECT SUCH AS, IN PARTICULAR, A TIMEPIECE, INCLUDING A PIEZOELECTRIC TRANSDUCER FOR ENTERING DATA MANUALLY

FIELD OF THE INVENTION

The present invention concerns a portable object such as, in particular, a timepiece, including a piezoelectric transducer for entering data manually. More particularly, the object of the present invention is to use the piezoelectric transducer operating as a sound generator in a wristwatch with an alarm device to perform the function of a push-button switch.

BACKGROUND OF THE INVENTION

There is known from U.S. Pat. No. 5,742,564 in the name of Junghans Uhren GmbH a timepiece such as a wristwatch including a flat or slightly dished case which is hermetically sealed by a crystal. A circular plate acting as a dial carries hour-symbols. This plate, arranged under the crystal, is fitted by force in the case. It is delimited at its periphery by a support collar which extends along the cylindrical inner surface of the case and which defines a space between the crystal and said plate in which the hands of the watch move. Piezoelectric sensors, preferably four in number, are arranged at regular intervals on the edge of the collar, between that edge and the edge facing the crystal. These sensors act as control switches for the horological functions of the watch. They are actuated manually by axial pressure on the edge of the crystal. In order to be able to respond to the stress exerted by the user, the crystal has to be able to move slightly. For this purpose, the crystal is mounted resiliently with respect to the case by means of a rigid rubber ring. The piezoelectric sensors are connected to an electric circuit arranged under the dial and which detects the pressure exerted on the sensors.

The invention disclosed in the Junghans Patent provides a wristwatch which has no stem or push-button and which is therefore less expensive to manufacture and has a more attractive aesthetic appearance. The horological functions of this watch are controlled by simple mechanical pressure on piezoelectric sensors which, in response to this stress, generate an electric voltage which acts on the desired horological function via an appropriate electronic circuit.

The Junghans watch unfortunately has certain drawbacks from among which one may cite the fact that the crystal has to be mounted so as to be able to move slightly, which poses significant problems for fitting this crystal with respect to the watch case. These problems of course have a negative effect on the manufacturing costs and are only partially resolved by the use of a rigid rubber ring arranged between said crystal and the middle part of said case. Indeed, because of its rigidity, it is difficult for the rubber ring to compensate for the plays between the crystal and the watch case, so that proper sealing cannot be guaranteed. There is thus a significant risk of humidity penetrating the watch which, as will easily be understood, is not acceptable. Likewise, particles of solid material can come between the rubber ring and the crystal and cause the operation of the mechanism to seize. Finally, as described above, the Junghans system is actuated by a succession of mechanical pressures exerted on the watch crystal. Under the effect of these pressures, the piezoelectric sensors are deformed and generate an electric voltage which is applied to the input of an electronic interpretation circuit. In response to this signal, the electronic circuit will act on the desired horological function. Repetition of such pressures is liable, after a certain time, to damage or even make the sensors unusable. Above all, it is not easy for the user to exert sufficient pressure to actuate the sensors without such pressure being excessive and liable to damage the sensors.

The object of the present invention is to overcome the above problems and drawbacks in addition to others by proposing a portable object whose manual data entry means include a piezoelectric transducer which is not liable to be damaged by excessive mechanical pressure.

SUMMARY OF THE INVENTION

The present invention therefore concerns a portable object such as, in particular, a timepiece, including means for displaying at least one data item and a case formed of a top portion including a crystal covering the display means and a bottom portion delimited by a back cover located below said display means, this object including a piezoelectric transducer generating an electric voltage when mechanical pressure is exerted on said top portion, the voltage generated by the piezoelectric transducer being applied to a first electronic circuit which will generate a logic signal in response to the pressure exerted, this electronic circuit being arranged inside said case, characterised in that said piezoelectric transducer is arranged in the bottom portion of said case and is rigidly connected to said case.

As a result of these features, the mechanical pressure which accompanies the manual entry of an item of data can be exerted at any location on the surface of the crystal. Under the effect of this pressure, the wrist of the person wearing the watch exerts a reaction force on the case. The latter is then very slightly deformed, whether it is made of plastic material, metal or another material. Since the piezoelectric transducer is rigidly connected to the case, it is deformed by the deformations of the case and generates, in a conventional manner, an electric voltage in response to this deformation. Thus there is no longer a risk of damaging the transducer by the effect of too high mechanical pressure. Likewise, the transducer, which is no longer wedged between a fixed part and a moving part, can bear a very high number of successive applications of pressure without its physical features deteriorating over time.

Another advantage of the present invention lies in the fact that the portable object does not include any moving parts. Thus, in the particular case of a timepiece such as a wristwatch, the watch crystal is fixedly mounted with respect to the case of said watch, for example by bonding or ultrasound welding or by driving it in while inserting a gasket between the crystal and the case. The sealing of the watch is thus not altered and the construction of such a watch proves very simple and thus inexpensive.

The present invention provides a watch whose horological functions can be controlled by applications of simple mechanical pressure on the crystal. Thus, the watch can do without a stem or push-button, which further reduces its manufacturing costs. Of course, other systems exist for entering data via tactile pressure which use, for example, capacitive, inductive, ultrasound or infrared keys. The drawback of such systems however lies in the fact that before being able to be used, they have to be placed in an active instruction receiving mode in which they use electric current. Conversely, the data entry system according to the present invention is permanently available without using any current.

According to a complementary feature of the invention, the portable object further includes a second electronic circuit which causes the piezoelectric transducer to operate as a vibration source for a sound generator.

As a result of this feature, the same piezoelectric transducer can be used both as a sound generator for an alarm device, for example in an electronic wristwatch, and as means for entering data by applications of mechanical pressure on the crystal of said watch. Such an embodiment, as will easily be understood, is particularly advantageous. It allows the number of components used to be reduced, and thus the volume which these components occupy in the case, and to limit the manufacturing costs.

BRIEF DESCRIPTION OF THE DRAWINGS

Other features and advantages of the present invention will appear more clearly upon reading the following detailed description of an example embodiment of the portable object according to the invention, this example being given purely by way of illustrative and non limiting example, in conjunction with the annexed drawings, in which.

DETAILED DESCRIPTION OF THE ILLUSTRATIVE EMBODIMENTS

It will be noted firstly that, although the following description concerns a timepiece and, in particular, a wristwatch, the present invention is not limited to such a timepiece and can easily be applied to any other portable object in which there is arranged a piezoelectric transducer allowing manual entry of data.

Figure 1:
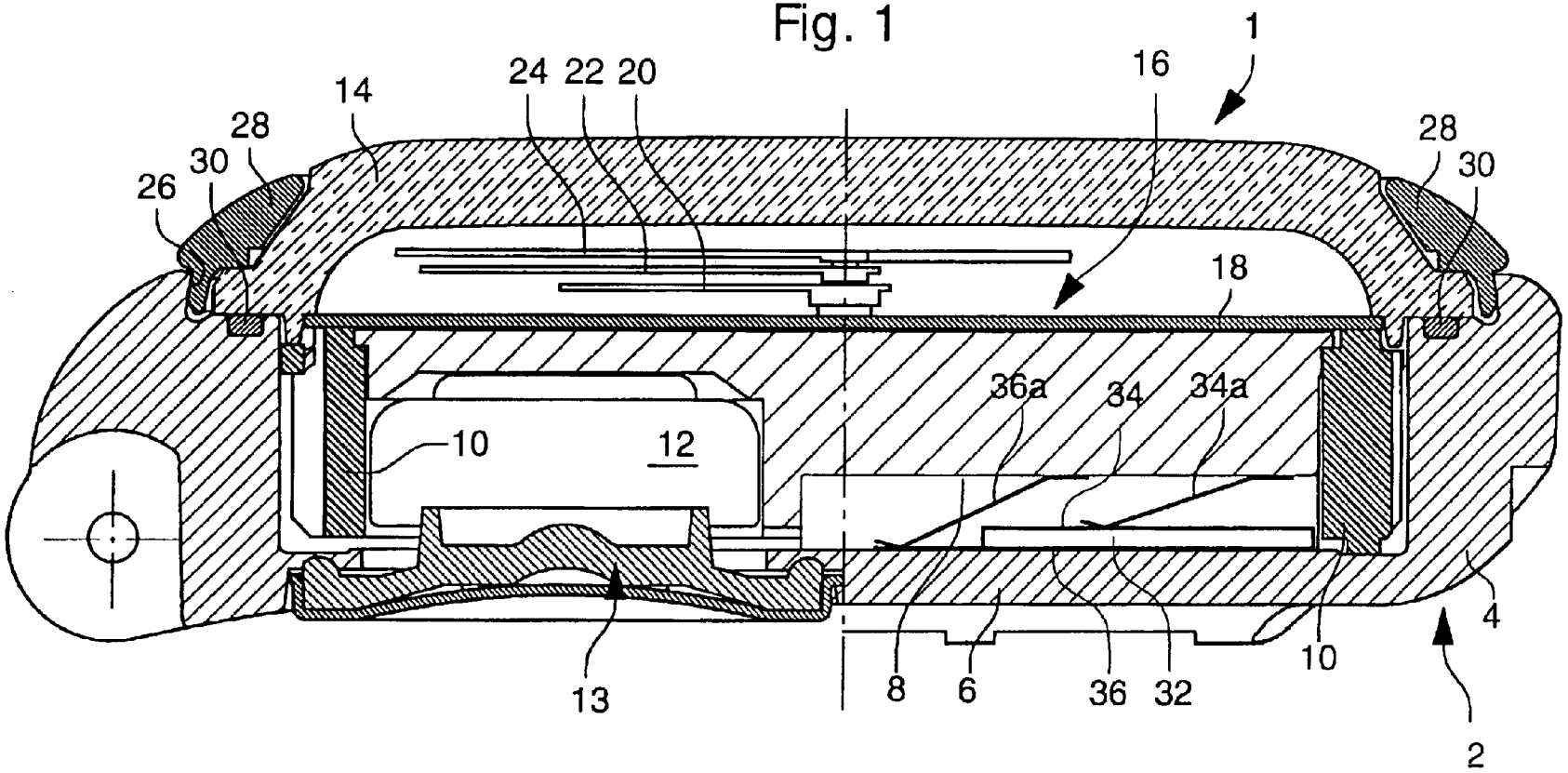
FIG. 1 is a general cross-section of a timepiece according to the invention.

Reference will be made first of all to FIG. 1 which shows a timepiece according to the invention, designated as a whole by the general numerical reference 1.

Timepiece 1 includes in a conventional manner, a case 2 provided with a middle part 4 and a back cover 6 which delimits case 2 in its bottom portion. In the example shown, back cover 6 is made in a single part with middle part 4. However, it goes without saying that the present invention also applies in the same way to a case which is not in a single part and which includes a back cover distinct from the middle part. Case 2 can be made, for example, in a plastic material in accordance with well known injection moulding techniques. The present invention is however not limited to choice of such material and case 2 could be made of any type of material suited to the requirements of the horological industry, such as, in particular, steel.

Timepiece 1 also includes a clockwork movement 8 mounted in a casing ring 10. This movement 8 is supplied with current by an electric battery 12 which may, if required, be recharged when run down. Battery 12, shown schematically in FIG. 1, typically has the shape of a button. It can be housed in back cover 6 of watch 1. The bottom face of battery 12 which forms one of its terminals is electrically connected to watch 1's earth, for example via a spring contact 13 secured to back cover 6 of watch 1. The other terminal of battery 12 which is formed by its top face is electrically connected to clockwork movement 8 in the usual manner.

In its top part, case 2 is delimited by a crystal 14 covering means 16 for displaying time-related data. In the example shown in FIG. 1, these display means 16 are formed of a dial 18 above which move an hour hand 20, a minute hand 22, and a second hand 24. They are thus analogue time display means. They could also be digital display means formed by a liquid crystal cell.

Finally, case 2 includes at its top periphery a notch 26 in which a bezel 28 is engaged which secures crystal 14 to case 2. Bezel 28 is fixedly mounted on case 2, for example by bonding or by ultrasound welding or by being driven in. Crystal 14 is made watertight with respect to case 2 as a result of the use of a sealing gasket 30 wedged between the crystal and the case.

According to the main feature of the present invention, a piezoelectric transducer 32 is arranged in the bottom part of case 2 of watch 1 and is rigidly connected to this case 2. This transducer 32 can be used for the sole purpose of entering data into watch 1. However, according to the preferred alternative embodiment of the invention, transducer 32 is used both as a sound generator for the alarm device of watch 1, and as means for entering data by successive applications of mechanical pressure on crystal 14 of watch 1. Piezoelectric transducer 32 is thus formed of an element made, for example, of piezoelectric ceramics. This element may have, in a non limiting manner, a circular shape, its diameter being typically comprised between ten and fifteen millimetres, and its thickness being of the order of several tenths of a millimetre. As FIG. 1 shows, this element is bonded between two top and bottom metal electrodes 34 and 36. Bottom electrode 36 is rigidly connected to back cover 6 of case 2 by any appropriate means such as, for example, by bonding. Electrodes 34, 36 are connected, via an electronic drive and interpretation circuit 38 which will be described in detail with reference to FIG. 2, to the terminals of electric battery 12 by means of contact strips respectively 34*a* and 36*a*.

Figure 2:
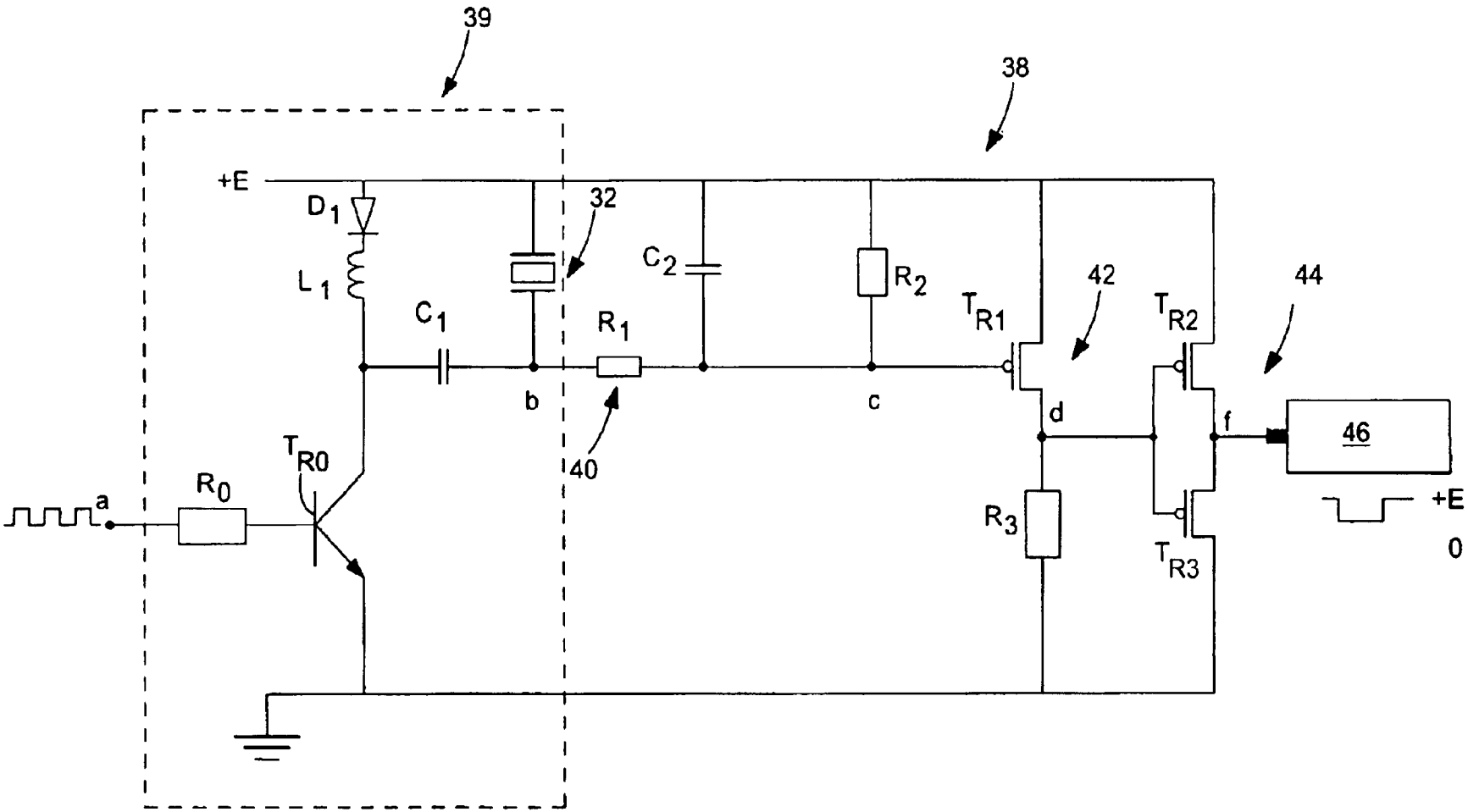
FIG. 2 shows an electric diagram of a circuit allowing the piezoelectric transducer operating as a sound generator to be used to perform the function of a push-button switch.
Figure 3:
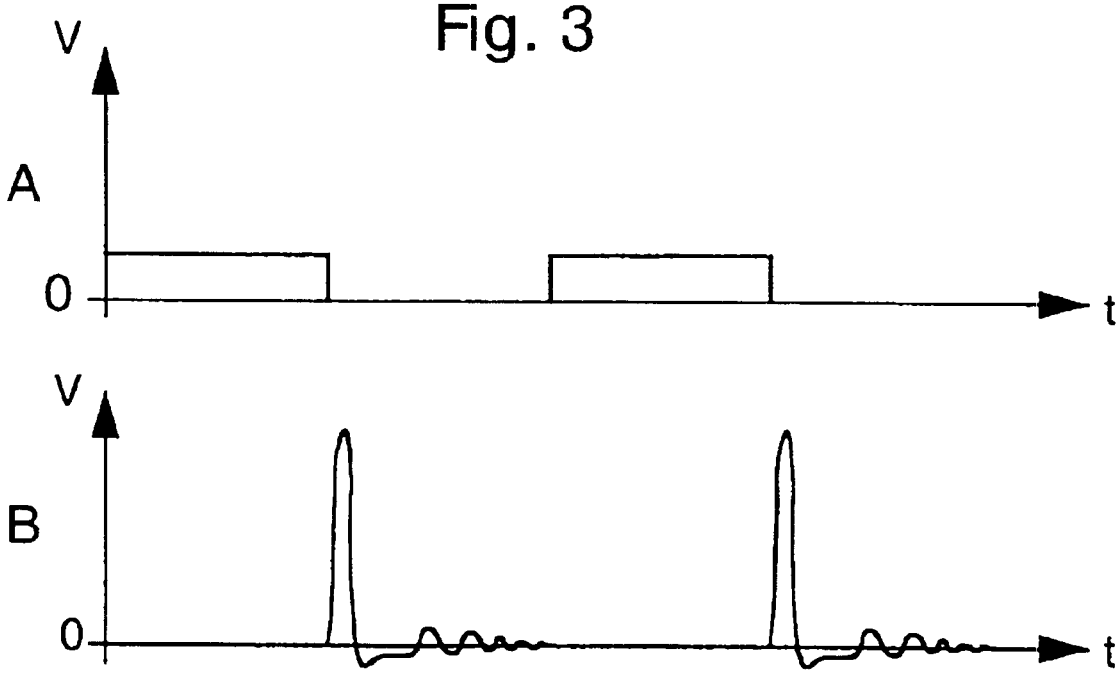
FIG. 3 is a diagram of the voltage levels as a function of time at two places on the circuit of FIG. 2.

Electric circuit 38 the diagram of which is shown in FIG. 2 includes a second electronic circuit 39 comprising, connected at the output of switching means including a transistor $T_{R0}$ which is alternately conducting and not conducting, a coil $L_1$. Piezoelectric transducer 32 is connected in parallel across coil $L_1$. This electric circuit 38 receives, at an input connection "a", a square control signal corresponding to what is shown by curve A of FIG. 3 the abscissa of which represents time "t" and the ordinate voltage "v". From input terminal "a", this signal is applied to the base of transistor $T_{R0}$ via a resistor $R_0$. When transistor $T_{R0}$, which is a bipolar npn transistor, is kept conducting by the pulse of the control signal, an electric current flows through coil $L_1$ from a direct-current voltage source +E, while connection "b" of piezoelectric transducer 32 is connected by transistor $T_{R0}$ to electric circuit 38's earth in accordance with what is shown by curve B of FIG. 3 (which has time "t" on the abscissa and voltage "v" on the ordinate).

At the moment at which transistor $T_{R0}$ passes to the non conducting state at the trailing edge of each pulse of waveshape A, any energy accumulated in coil $L_1$ is transmitted to the terminals of piezoelectric transducer 32, charging the latter with a much higher voltage than supply voltage +E. This high amplitude pulse supplies piezoelectric transducer 32 with the efficient electric energy which it needs to operate as a sound generator. According to a variant, to obtain higher acoustic pressure, a diode $D_1$ not shown could be mounted in series with coil $L_1$. For more further details, reference can be made to Swiss Patent No. 641 625 in the name of Seiko.

At this stage of the description, it is essential to understand that the circuit elements which have just been described are used solely to drive piezoelectric transducer 32 to make it operate as a sound generator in an alarm device fitted, for example, to wristwatch 1 described above. Consequently, these different components are not necessary to implement the present invention. They simply allow it to be demonstrated that, as a result of the particular features of the invention, a single piezoelectric transducer can advantageously be used both as a sound generator and as means for entering data in a watch. The following part of the description will concentrate on that part of electric drive and interpretation circuit 38 which allows a succession of applications of mechanical pressure to be converted into data able to be understood by a microprocessor fitted to watch 1 according to the present invention and allowing the horological functions of the latter to be controlled.

The successive applications of mechanical pressure which are exerted by the user on crystal 14 of watch 1 are converted, across the terminals of piezoelectric transducer 32 into a low frequency electric signal, typically of the order of 1 Hz, the level of which has to be increased. For this purpose, electric drive and interpretation circuit 38 shown in FIG. 2 includes, first of all, a capacitor $C_1$ mounted between coil $L_1$ and transducer 32. At low frequency, the impedance of coil $L_1$ is low, so that the latter practically plays the part of a short-circuit. Consequently, the variation in voltage at connection point "b" of transducer 32 is also low. In order to obviate to this problem capacitor $C_1$ is added. Indeed, the variation in voltage at connection "b" will only be significant if there is a high impedance at this connection point "b". However, at low frequency, capacitor $C_1$ has a high impedance, so that the voltage at said connection point "b" reaches a high threshold. Conversely, when piezoelectric transducer 32 is driven at high frequency, typically ranging about 1 kHz, to operate as a sound generator, capacitor $C_1$ has a low impedance and thus acts substantially like a simple electric connection between coil $L_1$ and transducer 32. Capacitor $C_1$ thus does not disturb the operation of transducer 32 as a sound generator.

Electric drive and interpretation circuit 38 is completed by a passive filter 40 mounted in parallel at the terminals of piezoelectric transducer 32. This filter 40 is formed in a conventional manner of a resistor $R_1$ and a capacitor $C_2$. The cut-off frequency beyond which filter 40 no longer allows a signal to pass is determined by the relationship $$f = \frac{1}{2\pi R_1 C_z}.$$

As will easily be understood, filter 40 is used to filter the high frequency present at the terminals of transducer 32 when the latter is operating as a sound generator at a frequency ranging about 1 Hz, and to prevent this signal propagating to the amplification and conversion stages which will be described hereinafter. Conversely, at low frequency, when piezoelectric transducer 32 is acted upon, the electric signal can pass.

Electric circuit 38 includes finally, connected in parallel one after the other at the terminals of passive filter 40, a polarisation resistor $R_2$, an amplification stage 42 and a conversion stage 44. Amplification stage 42 includes a pMOS transistor $T_{R1}$ whose source is connected to direct-current voltage source +E and whose drain is connected to a resistor $R_3$. The gate of transistor $T_{R1}$ is connected to one of the ends "c" of resistor $R_2$ the other end of which is connected to the source of direct-current voltage +E.

Any of the inverters available in current technology may be envisaged for conversion stage 44. Solely by way of non limiting example, conversion stage 44 includes a CMOS inverter which is formed of a pMOS transistor $T_{R2}$ connected to an nMOS transistor $T_{R3}$. The gates of these two transistors $T_{R2}$ and $T_{R3}$ are connected to connection point "d" between the drain of transistor $T_{R1}$ and resistor $R_3$. This connection point "d" constitutes the input of inverter 44. The source of pMOS transistor $T_{R2}$ is connected to the direct-current voltage source +E, and its drain is connected to the drain of transistor $T_{R3}$. Connection point "f" between the drains of transistors $T_{R2}$ and $T_{R2}$ constitutes the output of inverter 44. The source of transistor $T_{R2}$ is connected to circuit 38's earth.

When piezoelectric transducer 32 is at rest, i.e. when no pressure is being exerted on crystal 14 of watch 1, resistor $R_2$, which is of high enough value, is used to keep the gate-source voltage of transistor $T_{R1}$ at zero in order to prevent transistor $T_{R1}$ being conducting. It will also be noted that between two successive applications of pressure on transducer 32, the latter can be discharged through resistor $R_2$, so that the voltage across its terminals gradually finds its rest value.

As has just been seen in the above paragraph, when piezoelectric transducer 32 is at rest, transistor $T_{R1}$ does not conduct. Connection point "d" between the drain of transistor $T_{R1}$ and resistor $R_3$ is thus connected to circuit 38's earth. Connection point "d" constitutes the input of conversion stage 40. Consequently, the gate-source voltage of pMOS transistor $T_{R2}$ is equal to −E. This voltage is less than the threshold voltage of transistor $T_{R2}$ which is of the order of −0.6 volts, so that this transistor $T_{R2}$ conducts. At the same time, the gate-source voltage of nMOS transistor $T_{R3}$ is zero, i.e. less than the trigger voltage of transistor $TR_3$. Consequently, transistor $T_{R3}$ is non conducting. Thus, the voltage at connection point "f" which constitutes the output of conversion stage 44 is equal to +E while the voltage at connection point "d" which constitutes the input of conversion stage 40 is zero. Conversion stage 44 operates just like an inverter.

The event in which mechanical pressure is exerted on piezoelectric transducer 32 will now be examined. Under the effect of this pressure, transducer 32 polarises and the voltage at its connection point "b" decreases. Likewise, the gate voltage of pMOS transistor $T_{R1}$ decreases. The gate-source potential difference of transistor $T_{R1}$ will become less than the trigger voltage, so that this transistor $T_{R1}$ will begin to conduct. Under the effect of transistor $T_{R1}$'S conduction, the potential at connection point "d" which constitutes the input of conversion stage 44 will increase and tend towards +E. At that moment, the gate-source voltage of nMOS transistor $T_{R2}$ becomes greater than the threshold voltage of this transistor $T_{R2}$, so that said transistor $T_{R2}$ will pass to the non conducting state. At the same time, the gate-source voltage of nMOS transistor $T_{R3}$ becomes greater than the trigger voltage of this transistor $T_{R3}$, so that the latter will start to conduct. The voltage at connection point "f" which constitutes the output of conversion stage 44 will pass to zero. Thus, the voltage at the input of conversion stage 44 is at +E, while the output of conversion stage 40 is at zero. Conversion stage 44 operates just like an inverter.

The voltage at output point "f" of conversion stage 44 thus pass alternately from the value +E when piezoelectric transducer 32 is at rest to a zero voltage value when transducer 32 is actuated. This logic signal is applied to the input of a microprocessor 46 which will control the horological functions of watch 1.

It is to be noted that data may advantageously be entered via pressure on crystal 14 of watch 1 while transducer 32 operates as a sound generator. Indeed, passive filter 40 prevents the high frequency signals generated by transducer 28 reaching amplification stage 42 and conversion stage 44. Consequently, the data entry system according to the invention is permanently available. The filter can thus be digital, with switched capacitors or made with an active filter.

It will also be understood that the polarity of the supply voltage of electric drive and evaluation circuit 38 can be inverted. In such case, a pnp transistor will be substituted for bipolar npn transistor $T_{R0}$, and the pMOS transistors will be replaces by nMOS transistors and vice versa.

It goes without saying that various variants and simple modifications fall within the scope of the present invention.

What is claimed is:

1. A portable object, in particular, a timepiece, including means for displaying at least one data item and a case formed of a top portion including a crystal covering the display means and a bottom portion delimited by a back cover located below said display means, this object including a piezoelectric transducer generating an electric voltage when mechanical pressure is exerted on said top portion, the voltage generated by the piezoelectric transducer being applied to a first electronic circuit which will generate a logic signal in response to the pressure exerted, this electronic circuit being arranged inside said case, wherein said piezoelectric transducer is arranged in the bottom portion of said case and is rigidly connected to said case, said portable object further including a second electronic circuit that causes the piezoelectric transducer to operate as a vibration source for an acoustic generator, the first electronic circuit further including means for filtering the acoustic pulses generated by the piezoelectric transducer when the latter operates as a sound generator.

2. A portable object according to claim 1, wherein the piezoelectric transducer is bonded to the back cover of the case.

3. A portable object according to claim 1, wherein the first electronic circuit, connected in parallel across the piezoelectric transducer, includes amplification and conversion means in a logic signal of the voltage generated by said piezoelectric transducer under the effect of mechanical pressure.

4. A portable object according to claim 3, wherein the amplification and conversion means respectively include a circuit branch in which a transistor and a resistor are mounted in series and an inverter connected in parallel across said circuit branch.

5. A portable object according to claim 4, wherein the inverter is of the CMOS type.

6. A portable object according to claim 4, wherein a polarisation resistor is mounted in parallel between the piezoelectric transducer and the circuit branch including the transistor.

7. A portable object according to claim 1, wherein the filtering means include a resistor and a capacitor.

8. A portable object according to claim 1, wherein the filter is a digital filter, a filter with switched capacitors or made with an active filter.

9. A portable object according to claim 1, wherein the second electronic circuit includes:

switching means arranged to be activated upon reception of a pulsed control signal, these means supplying acoustic frequency pulses to the piezoelectric transducer;

means for supplying a voltage so as to cause an electrical current to flow in said switching means, and a coil connected between the means supplying a voltage and said switching means, said piezoelectric transducer being connected in parallel across the coil.

10. A portable object according to claim 9, wherein a capacitor is mounted between the coil and the piezoelectric transducer.

11. A portable object according to claim 9, wherein the second electronic circuit further includes a diode connected in series with the coil.

12. A portable object according to claim 9, wherein the switching means are formed by a transistor operating in switching mode.

13. A portable object according to claim 12, wherein the transistor is a bipolar transistor.

* * * * *